US008069843B2

(12) United States Patent
Lee

(10) Patent No.: US 8,069,843 B2
(45) Date of Patent: Dec. 6, 2011

(54) LUBRICATION APPARATUS OF FUEL PUMP DRIVEN BY FUEL PUMP DRIVE CAM

(75) Inventor: Seung Woo Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 326 days.

(21) Appl. No.: 12/552,127

(22) Filed: Sep. 1, 2009

(65) Prior Publication Data

US 2010/0126460 A1 May 27, 2010

(30) Foreign Application Priority Data

Nov. 25, 2008 (KR) ..... 10-2008-0117558

(51) Int. Cl.
*F01M 1/02* (2006.01)
*F01M 1/06* (2006.01)

(52) U.S. Cl. ..... 123/508; 123/196 R; 123/90.34

(58) Field of Classification Search ..... 123/508, 123/509, 196 R, 90.33–90.35
See application file for complete search history.

(56) References Cited

U.S. PATENT DOCUMENTS

| | | | | |
|---|---|---|---|---|
| 4,476,836 | A * | 10/1984 | Enomoto et al. | 123/502 |
| 5,984,650 | A * | 11/1999 | Okubo et al. | 417/470 |
| 6,502,565 | B2 * | 1/2003 | Schmid et al. | 123/572 |
| 2004/0011314 | A1 * | 1/2004 | Seader et al. | 123/90.34 |
| 2010/0139609 | A1 * | 6/2010 | Ahn | 123/196 R |
| 2010/0139610 | A1 * | 6/2010 | Park | 123/196 R |
| 2011/0100319 | A1 * | 5/2011 | Shin | 123/196 R |
| 2011/0126793 | A1 * | 6/2011 | Ahn | 123/196 R |

FOREIGN PATENT DOCUMENTS

| | | | |
|---|---|---|---|
| JP | 6-60708 | U | 8/1994 |
| KR | 10-2005-0058688 | A | 6/2005 |

* cited by examiner

*Primary Examiner* — Thomas Moulis
(74) *Attorney, Agent, or Firm* — Morgan, Lewis & Bockius LLP

(57) ABSTRACT

A lubrication apparatus of a fuel pump driven by a fuel pump drive cam, which lubricates a tappet moving reciprocally at an interior circumference of a fuel pump adaptor and the fuel pump operating the tappet, may include a cylinder head provided with a camshaft, an oil supplying passage formed in the camshaft as a hollow type so as to take oil to the interior of the camshaft, at least an oil branch passage formed to a cam lobe of the fuel pump drive cam so as to be communicated with the oil supplying passage, and a circular groove formed at the interior circumference of the fuel pump adaptor and corresponding to an injection direction of the oil supplied from the at least an oil branch passage.

9 Claims, 2 Drawing Sheets

LUBRICATION APPARATUS OF FUEL PUMP DRIVEN BY FUEL PUMP DRIVE CAM

CROSS-REFERENCE TO RELATED APPLICATION

The present application claims priority to Korean Patent Application No. 10-2008-0117558 filed on Nov. 25, 2008, the entire contents of which are incorporated herein for all purposes by this reference.

BACKGROUND OF THE INVENTION

1. Field of the Invention

This present invention relates to a lubrication structure of an engine, and more particularly to a fuel pump lubrication device that is capable of effectively lubricating a tappet of the engine, a tappet roller, and a cam.

2. Description of Related Art

Technologies for a gasoline direct injection (GDI) engine have been studied in order to improve fuel consumption and performance of the engine.

The GDI engine technologies are methods in which only air is drawn into the combustion chamber and is compressed and then fuel is injected therein, while in the case of a conventional gasoline engine, power is generated in a period of an intake stroke, a compression stroke, an ignition stroke, and an exhaust stroke process of an air/fuel mixture.

Such a method is similar to a compressed ignition engine method.

Due to a high compression ratio of the GDI engine, a high compression ratio that is capable of exceeding a limit of a usual gasoline engine results in maximization of fuel consumption.

The GDI engine depends on a high fuel pressure, and a high performance fuel pump is required.

The fuel pump is mechanically driven by a cam so as to operate a tappet, and friction inside the fuel pump is generated.

A great deal of friction occurs in the fuel pump due to the high pressure of the fuel.

Therefore, a lubrication device of the fuel pump for compressing the fuel in the GDI engine has been studied in order to improve durability and performance of the GDI engine.

To solve the problems, as an example, a method of lubricating the cam with oil stored in a predetermined space when a camshaft for the fuel pump is rotated is used.

Such a method has a merit of simplifying the structure, but it is difficult to lubricate throughout the fuel pump, and it is difficult to lubricate it at a slanted surface.

Further, there is a method, as another example, which forms an oil hole at the cam so as to flow oil therein.

However, the method mentioned above has a drawback in that it is capable of lubricating only a specific part that is provided with an oil hole, and it is impossible to form a hole at a portion of the cam contacting the tappet of the fuel pump.

In addition, the cam rotates in such a state in which it rotatably contacts the roller mounted at the bottom of the cam so as to operate the tappet upwardly and downwardly, and the conventional tappet lubrication structure of the engine guides the tappet upwardly and downwardly by the roller between the tappet and the cam, but contact surfaces between the tappet and the fuel pump adaptor and between the cam and the roller are not lubricated smoothly thereby inducing abrasion, and consequently durability and rotation thereof are deteriorated.

Therefore, due to the abrasion occurring at the roller interposed between the cam and the roller tappet, durability thereof is deteriorated and thereby manufacturing cost is increased, and noise occurs at the contact portion thereof.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a lubrication apparatus of a fuel pump driven by a fuel pump drive cam having advantages of improving durability and rotation performance of the fuel pump, and thereby reducing noise generated by friction therebetween, in which it directly lubricates a contact surface of the fuel pump drive cam and a tappet roller.

A lubrication apparatus of a fuel pump driven by a fuel pump drive cam, which lubricates a tappet moving reciprocally at an interior circumference of a fuel pump adaptor and the fuel pump operating the tappet, may include a cylinder head provided with a camshaft, an oil supplying passage formed in the camshaft as a hollow type so as to take oil to the interior of the camshaft, at least an oil branch passage formed to a cam lobe of the fuel pump drive cam so as to be communicated with the oil supplying passage, and a circular groove formed at the interior circumference of the fuel pump adaptor and corresponding to an injection direction of the oil supplied from the at least an oil branch passage.

A center axis of the circular groove may be parallel to a motion axis of the tappet.

The at least an oil branch passage may be formed so as to be slanted toward the circular groove, wherein the at least an oil branch passage is formed about an axis line of the camshaft.

The at least an oil branch passage may be slanted with a predetermined angle from a rotational axis of the camshaft toward the circular groove.

The circular groove may be formed and dimensioned such that the oil injected from the at least an oil branch passage strikes an inner circumference of the circular groove and then the oil is reflected toward a contact surface of the cam and the tappet roller.

The at least an oil branch passage may be mounted at a gasoline direct injection engine so as to supply the oil to the fuel pump.

The circular groove may be formed along the interior circumference of the fuel pump adaptor, and the cross-section thereof is a half-circle.

One of the at least an oil branch passage and the other of the at least an oil branch passage may be slanted from a rotational axis of the crankshaft with substantially the same angle and disposed with straight angle therebetween.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
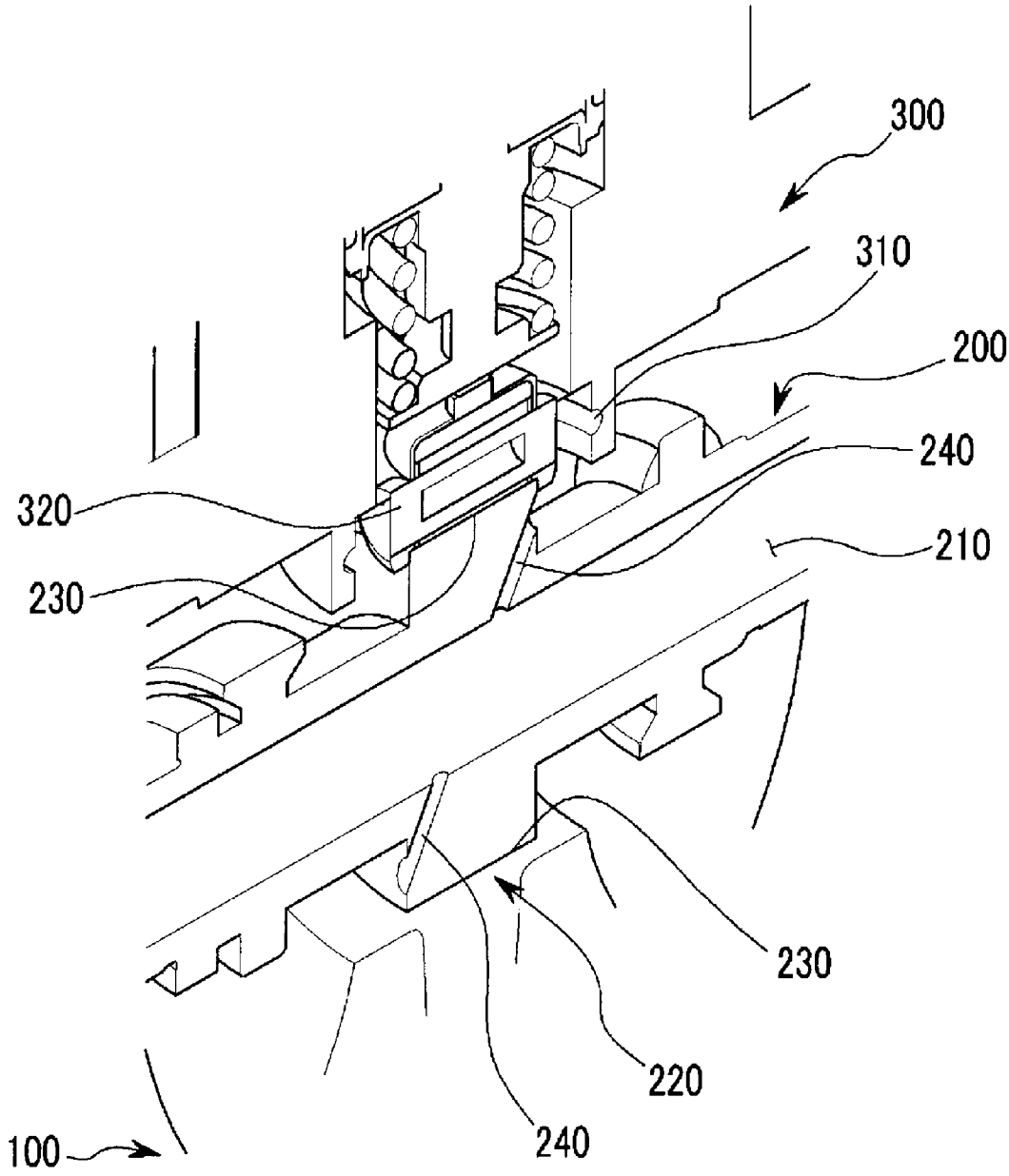
FIG. 1 is a perspective view showing a main portion of a lubrication apparatus of a fuel pump driven by a fuel pump drive cam according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
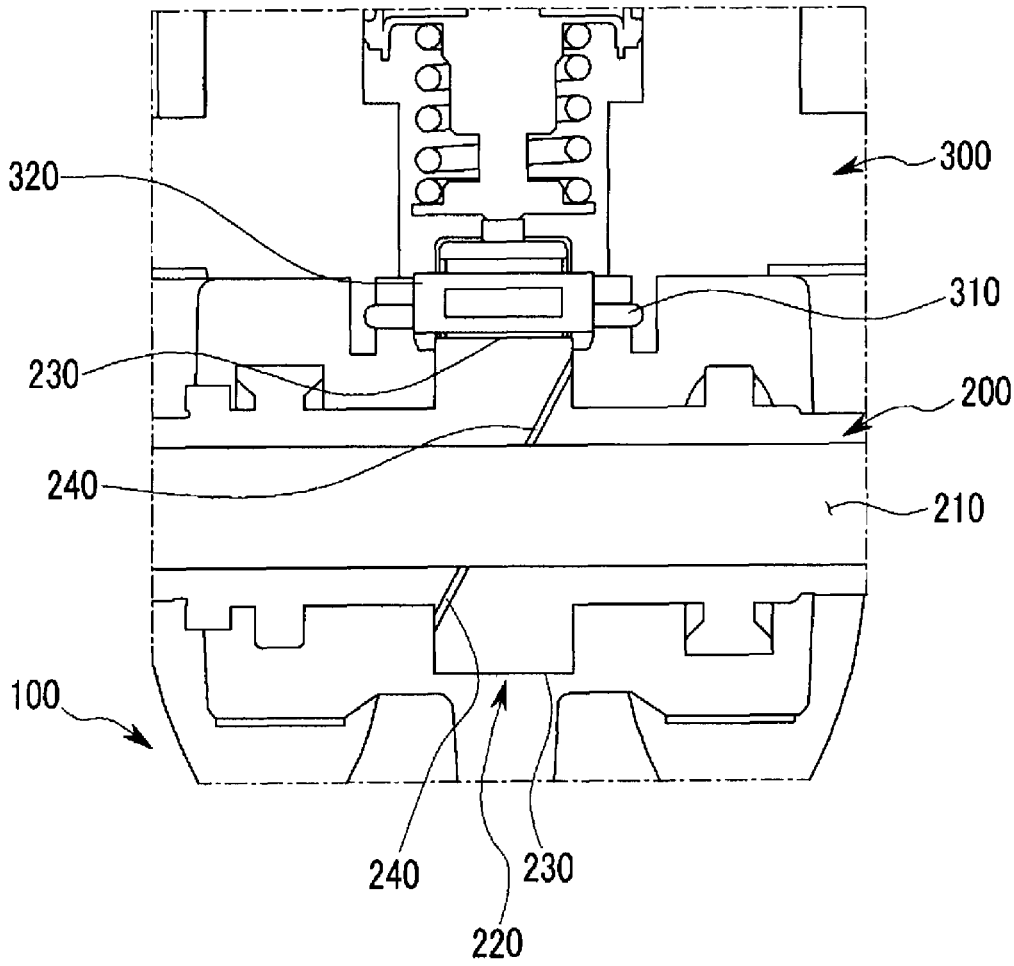
FIG. 2 is a cross-sectional view showing a lubrication apparatus of a fuel pump driven by a fuel pump drive cam according to an exemplary embodiment of the present invention.

FIG. 1 is a perspective view showing a main portion of a lubrication apparatus of a fuel pump driven by a fuel pump drive cam according to an exemplary embodiment of the present invention, and FIG. 2 is a cross-sectional view showing a lubrication apparatus of a fuel pump driven by a fuel pump drive cam according to an exemplary embodiment of the present invention.

As shown in FIG. 1 and FIG. 2, a lubrication apparatus of a fuel pump driven by a fuel pump drive cam according to an exemplary embodiment of the present invention can be applied to a high-pressure fuel pump used in a gasoline engine.

Before an exemplary embodiment of the present invention is described, a schematic structure with reference to the present invention will be described.

A conventional high-pressure fuel pump includes a cylinder, a tappet, a plunger, and a compressor.

The tappet is operated by a fuel pump drive cam 220 assembled to an intake camshaft of an engine, and is moved upwardly and downwardly in the cylinder.

Also, the tappet is provided with the plunger integrally formed at an upper portion thereof, and the tappet is rotated together with a tappet roller 320 in such a state that the tappet contacts the fuel pump drive cam.

The fuel pump drive cam may be provided with two or more cam lobes 230 disposed thereon, and being divided by equal angles about a camshaft.

Therefore, the plunger receives pressure by rotation of the cam lobes 230, and the plunger pressurizes a compression chamber of the fuel pump mounted at an upper portion thereof.

Further, the compression chamber of the high-pressure fuel pump is divided by the plunger and the cylinder.

Such a compression chamber is provided with a low-pressure fuel pipe, and is communicated with a lift pump.

Further, the compression chamber is provided with a high-pressure fuel pipe, and is communicated with the interior of a delivery pipe.

Such the delivery pipe is connected to an injector, and it injects fuel into the combustion chamber of each cylinder.

An exemplary embodiment of the present invention described above will be hereinafter described in detail.

An oil supplying line is connected to an oil supplying passage 210 of a camshaft 200 so as to supply oil thereto.

Therefore, the oil is injected from an oil pump and is supplied to a fuel pump adaptor 300 through the oil supplying line of the cylinder head 100 for lubricating and cooling.

In addition, an oil branch passage 240 is provided to the camshaft 200 such that it is communicated with the oil supplying passage 210 and penetrates to the exterior through the fuel pump drive cam 220.

Herein, there may be multiple oil supplying passages 240 around the axis line of the camshaft 200.

At this time, the oil branch passage 240 is formed such that it is slanted, and the oil injected from the oil supplying passage 240 faces a circular groove 310 formed at an interior circumference of the fuel pump adaptor 300.

That is, the oil injected from the oil supplying passage 240 strikes the circular groove of the fuel pump adaptor 300, and then reflects to a contacting surface of the tappet roller 320 and the cam lobe 230.

In doing so, the oil injected from the oil supplying passage 240 is simultaneously able to lubricate the contacting surface of the tappet roller 320 and the fuel pump drive cam 220.

In an exemplary embodiment of the present invention, the cam lobe 230 may include two oil supplying passage 240. These two oil supplying passage 240 may be slanted from a rotational axis of the crankshaft with substantially the same angle and disposed with a straight angle therebetween.

Accordingly, a fuel pump lubrication apparatus driven by a cam described above is capable of improving durability and rotation performance of the fuel pump, and thereby noise generated by friction therebetween, by directly lubricating the contact surface of the fuel pump drive cam 220 and the tappet roller 320.

Further, since an oil jet is not required for configuring of oil passages, the manufacturing cost may be reduced.

For convenience in explanation and accurate definition in the appended claims, the terms "upper", "lower", and "inner" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lubrication apparatus of a fuel pump driven by a fuel pump drive cam, which lubricates a tappet moving reciprocally at an interior circumference of a fuel pump adaptor and the fuel pump operating the tappet, comprising:

a cylinder head provided with a camshaft;

an oil supplying passage formed in the camshaft as a hollow type so as to take oil to the interior of the camshaft;

at least an oil branch passage formed to a cam lobe of the fuel pump drive cam so as to be communicated with the oil supplying passage; and a circular groove formed at the interior circumference of the fuel pump adaptor and corresponding to an injection direction of the oil supplied from the at least an oil branch passage.

2. The apparatus of claim 1, wherein a center axis of the circular groove is parallel to a motion axis of the tappet.

3. The apparatus of claim 1, wherein the at least an oil branch passage is formed so as to be slanted toward the circular groove.

4. The apparatus of claim 3, wherein the at least an oil branch passage is formed about an axis line of the camshaft.

5. The apparatus of claim 1, wherein the at least an oil branch passage is slanted with a predetermined angle from a rotational axis of the camshaft toward the circular groove.

6. The apparatus of claim 1, wherein the circular groove is formed and dimensioned such that the oil injected from the at least an oil branch passage strikes an inner circumference of the circular groove and then the oil is reflected toward a contact surface of the cam and the tappet roller.

7. The apparatus of claim 1, wherein the at least an oil branch passage is mounted at a gasoline direct injection engine so as to supply the oil to the fuel pump.

8. The apparatus of claim 1, wherein the circular groove is formed along the interior circumference of the fuel pump adaptor, and the cross-section thereof is a half-circle.

9. The apparatus of claim 1, wherein one of the at least an oil branch passage and the other of the at least an oil branch passage are slanted from a rotational axis of the crankshaft with substantially the same angle and disposed with straight angle therebetween.

* * * * *